US009039890B2

(12) United States Patent
Cash et al.

(10) Patent No.: US 9,039,890 B2
(45) **Date of Patent: *May 26, 2015**

(54) TWO-STAGE, CLOSE-COUPLED, DUAL-CATALYTIC HEAVY OIL HYDROCONVERSION PROCESS

(75) Inventors: Dennis R. Cash, Novato, CA (US); Graham J. Forder, San Rafael, CA (US); David S. Mitchell, San Rafael, CA (US); Joel W. Rosenthal, Lafayette, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 213 days.

This patent is subject to a terminal disclaimer.

(21) Appl. No.: 13/358,495

(22) Filed: Jan. 25, 2012

(65) Prior Publication Data

US 2012/0118791 A1 May 17, 2012

Related U.S. Application Data

(63) Continuation-in-part of application No. 13/134,604, filed on Jun. 10, 2011.

(60) Provisional application No. 61/360,259, filed on Jun. 30, 2010, provisional application No. 61/384,572, filed on Sep. 20, 2010, provisional application No. 61/575,814, filed on Aug. 29, 2011.

(51) Int. Cl.

| | |
|---|---|
| ***C10G 65/12*** | (2006.01) |
| ***C10G 1/06*** | (2006.01) |
| ***C10G 65/02*** | (2006.01) |
| ***C10G 65/10*** | (2006.01) |
| ***C10G 1/00*** | (2006.01) |

(52) U.S. Cl.

CPC ..... *C10G 65/12* (2013.01); *C10G 65/02* (2013.01); *C10G 65/10* (2013.01); *C10G 1/002* (2013.01); *C10G 2300/205* (2013.01); *C10G 2300/107* (2013.01); *C10G 2300/1077* (2013.01); *C10G 2300/206* (2013.01); *C10G 2300/301* (2013.01)

(58) Field of Classification Search

CPC ..... C10G 65/02; C10G 65/10; C10G 65/12
USPC ..... 208/57–59, 68, 89
See application file for complete search history.

(56) References Cited

U.S. PATENT DOCUMENTS 4,054,504 A * 10/1977 Chervenak et al. ..... 208/408
4,391,699 A 7/1983 Rosenthal (Continued)

OTHER PUBLICATIONS

International Search Report from corresponding PCT application No. PCT/US2012/038267 mailed Jul. 31, 2012.

*Primary Examiner* — Renee E Robinson
(74) *Attorney, Agent, or Firm* — Melissa M. Hayworth; Mary R. Bram; Steven R. Ellinwood

(57) ABSTRACT

A process for the production of high yields of high quality products from heavy hydrocarbonaceous feedstock comprising a two-stage, close-coupled process, wherein the first stage comprises a thermal-catalytic zone into which is introduced a mixture comprising the feedstock, coal, dispersed catalyst, and hydrogen; and the second, close-coupled stage comprises a catalytic-hydrotreating zone into which substantially all the effluent from the first stage is directly passed and processed under hydrotreating conditions.

23 Claims, 1 Drawing Sheet

(56) References Cited

U.S. PATENT DOCUMENTS

| | | | | |
|---|---|---|---|---|
| 4,422,922 | A | 12/1983 | Rosenthal et al. | |
| 4,564,439 | A * | 1/1986 | Kuehler et al. | 208/59 |
| 4,591,426 | A | 5/1986 | Krasuk et al. | |
| 4,761,220 | A | 8/1988 | Beret et al. | |
| 4,842,719 | A | 6/1989 | Macarthur et al. | |
| 4,851,107 | A | 7/1989 | Kretschmar et al. | |
| 5,166,118 | A | 11/1992 | Kretschmar et al. | |
| 5,871,638 | A | 2/1999 | Pradhan et al. | |
| 6,544,409 | B2 | 4/2003 | De Souza | |
| 2009/0288984 | A1 * | 11/2009 | Colyar et al. | 208/49 |
| 2012/0067775 | A1 | 3/2012 | Cash et al. | |

* cited by examiner

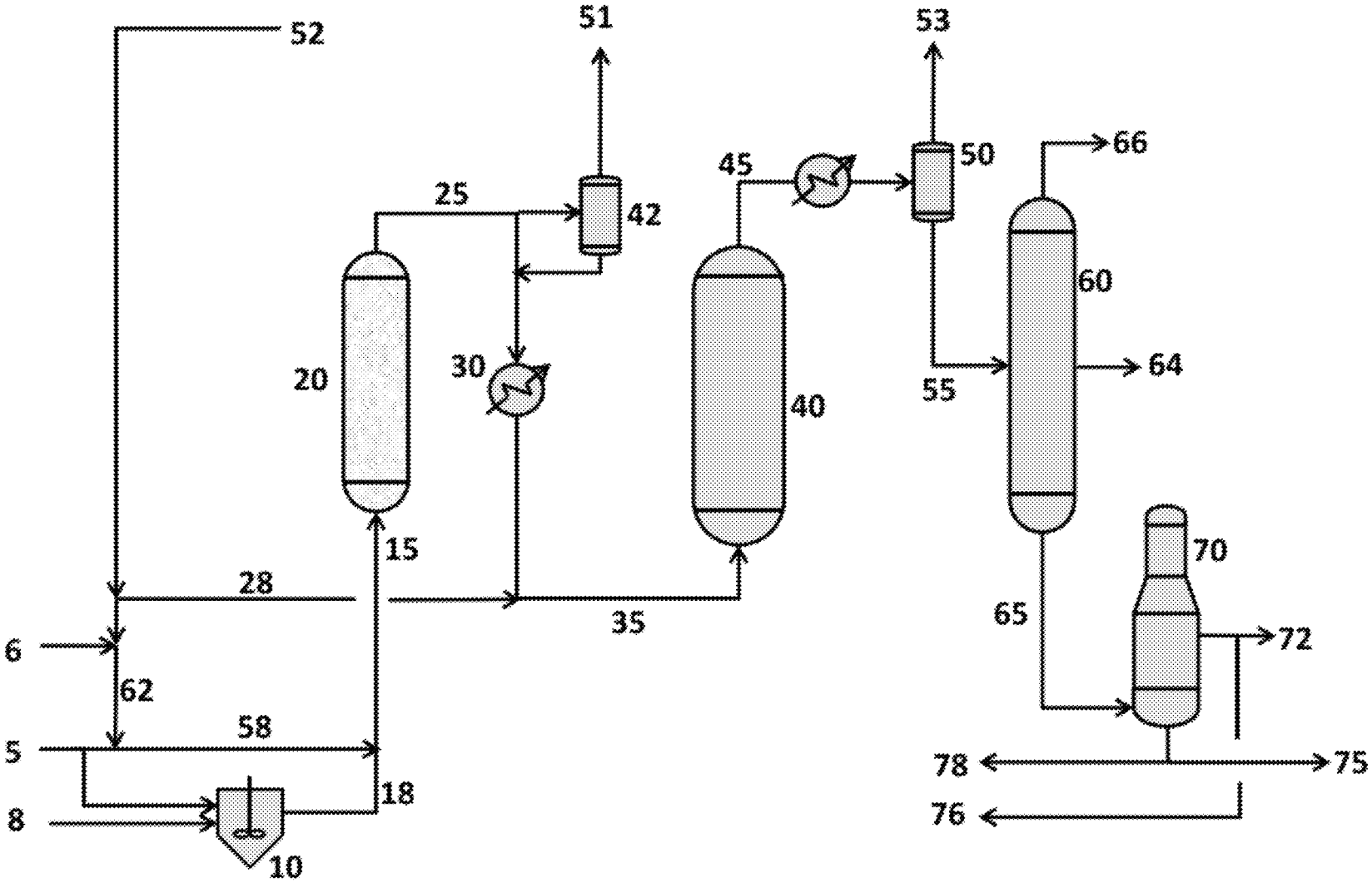
52
51
53
66
64
72
75
78
76
6
5
8
10
18
58
62
28
15
20
25
30
35
40
42
45
50
55
60
65
70

TWO-STAGE, CLOSE-COUPLED, DUAL-CATALYTIC HEAVY OIL HYDROCONVERSION PROCESS

CROSS-REFERENCE TO RELATED APPLICATIONS

This application is a continuation-in-part of application Ser. No. 13/134,604, filed 10 Jun. 2011, which application claims benefit of Provisional Application Nos. 61/360,259, filed 30 Jun. 2010, and 61/384,572, filed 20 Sep. 2010, and this application also claims benefit of Provisional Application No. 61/575,814, filed 29 Aug. 2011.

BACKGROUND OF THE INVENTION

1. Field of the Invention

The present invention relates to a process for the hydroconversion of heavy hydrocarbonaceous fractions of petroleum. In particular, it relates to a close-coupled two-stage; thermal-catalytic, catalytic-hydrotreatment process for converting petroleum heavy oils that provides improved effectiveness for high conversion and control of condensation reactions to produce stable high-quality products.

2. Background

Increasingly, petroleum refiners find a need to make use of heavier or poorer quality crude feedstocks in their processing. As that need increases, the need also grows to process the fractions of those poorer feedstock's boiling at elevated temperatures, particularly those temperatures above 1000° F. High conversions to stable, quality products are desirable in order to avoid producing significant quantities of low value fuel oil. Delayed Coking, the refiner's traditional solution for converting heavy oils to liquid products, has become less attractive because of the low conversion to liquid products and the relatively low value of the coke by-product. Higher liquid conversions can be achieved with conventional ebullated bed technologies. But these technologies, even with enhancements such as solvent de-asphalting, suffer limitations due to the instability of the fuel oil product and refractive nature of the products—making further upgrading difficult.

Severe conditions are required in order to achieve high conversions which, while producing desirable lighter fractions, can also produce thermally cracked fragments and unstable asphaltenes that form mesophase masses. Unless controlled, the cracked fragments undergo condensation reactions to undesirable polycyclic molecules which tend to be unstable and difficult to process into desirable products. Along with the mesophase masses, they can also lead to coke formation.

The key to high conversion and product quality is the management of the asphaltenes which are produced at severe operating conditions. Current approaches have focused on slurry reactor technology utilizing sophisticated dispersed catalyst systems, in some cases employing molybdenum. These technologies tend to have high investment and operating costs and, in some cases, product quality remains an issue. Many of these processes also have difficulties if the metals content of the feedstock is high.

Various processes for the conversion of heavy hydrocarbonaceous fractions, particularly, multi-stage conversion processes include those described in U.S. Pat. No. 4,761,220, Beret, et al.; U.S. Pat. No. 4,564,439, Kuehler, et al.; U.S. Pat. No. 4,330,393, Rosenthal, et al.; U.S. Pat. No. 4,422,922, Rosenthal, et al.; U.S. Pat. No. 4,354,920, Rosenthal, et al; U.S. Pat. No. 4,391,699, Rosenthal, et al.

SUMMARY

The present invention is, in broad scope, a process for converting the portion of heavy oil feedstock boiling above 1000° F., to produce high yields of high quality products boiling below 1000° F. Compared to existing processes, the products are reduced in heteroatom content, reduced in condensed molecules and are more readily processed to finished fuels.

The process comprises introducing a mixture comprising heavy oil feedstock, coal and dispersed catalyst particles, into a first-stage thermal-catalytic zone in the presence of hydrogen and operated at elevated temperature and pressure. The feedstock, coal and dispersed catalyst mixture is introduced into the thermal-catalytic zone under conditions sufficient to convert a significant amount of hydrocarbons in the feedstock boiling above 1000° F. to hydrocarbons boiling below 1000° F. In one embodiment, substantially all of the thermal-catalytic zone gaseous, liquid and solid effluent is passed directly, in a close-coupled manner, into a second stage catalytic-hydrotreating zone with inter-zone cooling to reduce temperature prior to the second stage zone. The first zone effluent is contacted with hydrotreating catalysts under hydrotreating conditions, and the effluent from catalytic-hydrotreating reaction zone is recovered. In another embodiment a portion of the gaseous products from the first stage thermo-catalytic zone is removed. In this embodiment, substantially all of the thermal-catalytic zone liquid and solid effluent is passed directly, in a close-coupled manner, into a catalytic-hydrotreating reaction zone with inter-zone cooling to reduce temperature prior to the second stage zone. As in the first embodiment, the first zone effluent is contacted with hydrotreating catalysts under hydrotreating conditions, and the effluent from catalytic-hydrotreating reaction zone is recovered.

DESCRIPTION OF THE DRAWINGS

FIG. 1 is a schematic flow diagram of one embodiment of the process of the present invention.

DETAILED DESCRIPTION

This invention is a process for hydroconversion of heavy oil feedstocks that effectively controls asphaltene condensation by utilization of a combination of dispersed coal, dispersed catalyst, and a two-stage close-coupled thermo-catalytic reactor/catalytic-hydrotreating reactor configuration. It converts heavy hydrocarbonaceous feed-stocks, a significant portion of which boils above 1000° F., to high yields of high quality products boiling below 1000° F.

The process, in one embodiment, is a two-stage, close-coupled process, the first stage of which encompasses a thermal-catalytic zone, wherein the feedstock is substantially converted to lower boiling products. The product of the thermal-catalytic zone is cooled somewhat and passed directly, without substantial loss of hydrogen partial pressure, into a catalytic-hydrotreating zone, where the thermal-catalytic zone effluent is hydrotreated to produce hydrotreated products suitable for further treatment into transportation fuels and other products. In the thermal-catalytic zone, the dispersed catalyst catalyses the hydrogenation of thermally cracked fragments and stabilizes them thus preventing condensation reactions. The dispersed catalyst also hydrogenates coal liquids, which coal liquids in a non-catalytic process also act to hydrogenate thermally cracked fragments by donating hydrogen to them. The coal liquids also act to solubilize asphaltenes and asphaltenes precursors and inhibit the formation of mesophase masses. The close-coupled catalytic-hydrotreater plays a key role in promptly stabilizing remaining thermally cracked fragments from the first stage, hydrogenating products, removing heteroatoms and effecting some further molecular weight reduction. The unconverted coal and coal ash sequester the metals in the feedstock in the first stage thermal-catalytic zone which results in substantial reduction of metals fouling of the supported hydrotreating catalyst in the catalytic-hydrotreating zone.

Thermal-catalytic cracking tends to produce unstable products. This can lead to both the fouling of downstream equipment and the production of poor quality products. Placing the lower temperature catalytic-hydrotreating zone directly after the thermal-catalytic zone (in a single high pressure loop) assures the prompt saturation of unstable molecules that were created in the thermal-catalytic reactor. In contrast to conventional processing, which places separations steps after the thermal-catalytic reactor, and does not directly pass the liquids and liquids/solids from the thermal-catalytic zone to a catalytic-hydrotreating zone, this prompt stabilization significantly reduces the polymerization of unstable molecules to form undesirable asphaltenes. Thus, the zones are "close-coupled". Close-coupled then, refers to the connective relationship between these zones. The pressure between the thermal-catalytic zone and the catalytic-hydrotreating zone is maintained such that there is no substantial loss of hydrogen partial pressure. In a close-coupled system also, there is no separation of solids from liquids as the thermo-catalytic effluent passes from one zone to the other, and there is no more cooling and reheating than necessary. However, it is preferred to cool the first-stage effluent by passing it through a cooling zone prior to the second stage. This cooling does not affect the close-coupled nature of the system. The cooling zone will typically contain a heat exchanger or similar means, whereby the effluent from the thermal-catalytic reactor zone is cooled to a temperature between 600-800° F. in order to reach a temperature suitable for hydrotreating without excessive fouling of the hydrotreating catalyst in the catalytic-hydrotreater. Some cooling may also be effected by the addition of a fresh, cold, hydrogen-rich stream.

Feedstocks finding particular use within the scope of this invention are heavy hydrocarbonaceous feedstocks, at least 30 volume percent, preferably 50 volume percent of which boils above 1000° F. Examples of typical feedstocks include crude petroleum, topped crude petroleum, reduced crudes, petroleum residua from atmospheric or vacuum distillations, solvent deasphalted tars and oils, and heavy hydrocarbonaceous liquids including residua derived from coal, bitumen, or coal tar pitches. Herein, these feedstocks are referred to as "heavy oil". Other feedstocks such as vacuum gas oils, coker gas oils, and FCC cycle oils may also be favorably co-processed with these heavy oils.

The process of the invention may be more fully understood by reference to FIG. 1 that illustrates one embodiment of the invention. Heavy oil feedstock (hydrocarbonaceous feedstocks, a significant portion of which boils above 1000° F.) enters the process by line 5. Some portion of the feed is mixed (mixer 10) with finely divided coal and catalyst from line 8 to disperse the coal and catalyst in the heavy oil. Hydrogen is introduced via conduit 62 and constitutes fresh hydrogen via conduit 6, recycled gases via conduit 52 or mixtures thereof. It is an essential feature of this invention that the added coal and catalyst be highly dispersed. The added coal and dispersed catalyst particles are mixed in mixing zone 10 with feed to form a slurry, preferably a dispersion or uniform distribution of particles within the feed, which is introduced into a first-stage thermal-catalytic reactor 20 via conduit 18 together with heavy oil feed via conduit 58. Coal is added in the mixture in a concentration relative to the feedstock from 0.5 to 40 percent by weight, preferably 0.5 to 20 percent by weight and more preferably from about 3 to 10 percent by weight. About 3 to 10 percent coal addition will be suitable for most feeds and operations. High volatile bituminous coals are preferred due to their high hydroaromatic content and ease of liquefaction, but coals of other rank may be suitable. The coal particles must be finely divided, having a maximum diameter of about 40 mesh U.S. sieve series, preferably smaller than 100 mesh and more preferably under 10 microns.

Prior to introduction into the first-stage thermo-catalytic zone, the feedstock slurry and hydrogen-containing streams are heated to provide an operating temperature of between 750° F. to 900° F., preferably 800° F. to 875° F., in the zone. This heating may be done to the entire feed to the zone or may be accomplished by segregated heating of the various components or combinations of the components of the total feed (for example, feed-solids slurry, feed-gas mixture, feed only, gas only).

The heated combined oil, hydrogen-rich gas, coal and catalyst pass by line 15 to an upflow thermo-catalytic slurry reactor 20 and out by conduit 25 to cooling means 30 and by conduit 35 to hydrotreating reactor 40. Hydrogen-rich gas may be added by line 28. In addition to cooling the thermo-catalytic effluent stream, this gas addition will result in higher hydrogen partial pressure and lead to more efficient usage of the hydrotreater catalyst. The short route of products from reactor 20 to reactor 40 helps to minimize asphaltene and mesophase production. However, in some embodiments, it may be desirable to remove a portion of the gas that is present in the thermal-catalytic zone. Since small quantities of water and light gases are produced in the thermal-catalytic zone, the catalyst in the catalytic-hydrotreating zone may be subjected to a slightly lower hydrogen partial pressure than if these materials were absent. Thus, in this embodiment effluent from reactor 20 passes by line 25 to separator 42. Preferably, the entire bottoms stream from separator 42 is passed to the catalytic-hydrotreating zone. Furthermore, this inter-stage removal of the carbon monoxide and other oxygen-containing gases may reduce the hydrogen consumption in the catalytic-hydrotreating stage. The removal of all or a portion of the gas from the thermal-catalytic zone might also be done to provide improved hydrodynamics in the downstream catalytic-hydrotreating zone. In any case, the removal of gas is to be done in a manner that does not cause significant delay in the movement of solids-containing liquids from the thermal-catalytic zone to the catalytic-hydrotreating zone where the process conditions are more favorable for the stabilization of heavy hydrocarbon molecules. This hydrogen-rich stream (conduit 51) may be treated and recycled to the thermal-catalytic or catalytic-hydrotreating zones.

Effluent from reactor 40 passes by conduit 45 to separator 50 where the gas phase is separated from the liquid/solids phase. The gas phase (conduit 53) may be treated and recycled back to the thermo-catalytic and/or the catalytic-hydrotreating zone. The liquid/solids bottoms from the separator 50 passes by conduit 55 to atmospheric distillation column 60 where gases are removed by conduit 66 and liquid fractions are removed as schematically shown by conduit 64. In operation several streams of different boiling range products may be separately removed. The bottoms stream (conduit 65) is further distilled in vacuum column 70 to separate a vacuum distillate product (conduit 72) from a solids-containing vacuum bottoms stream (conduit 75). In some cases it may be desirable to recycle all or a portion of these streams back to the feed system via conduits 76 and/or 78.

Other reaction conditions in the thermal-catalytic zone include residence time of from 0.5 to 3 hours, preferably 0.5 to 1.5 hours; a hydrogen partial pressure in the range of 35 to 300 atmospheres, preferably 100 to 200 atmospheres, and more preferably 100 to 175 atmospheres; and a hydrogen gas rate of 350 to 3000 liters per liter of feed mixture and preferably 400 to 2000 liters per liter of feed mixture. Under these conditions, a significant amount of the hydrocarbons in the feedstock boiling above 1000° F. is converted to hydrocarbons boiling below 1000° F. In this invention, the percentage of hydrocarbons boiling above 1000° F. converted to those boiling below 1000° F. are at least 50 percent, more preferably 75 percent and most preferably more than 90 percent.

The dispersed catalyst is present in the mixture in a concentration relative to the feedstock of from about 0.1 to 5 percent by weight, preferably 0.5 to 1 percent by weight. Suitable dispersed catalyst particles would be the oxides or sulfides of metals selected from Groups V1b, V11b and V111b. It is preferred that the dispersed catalyst not be supported on a base material. The dispersed catalyst may be either synthetic or naturally occurring minerals such as limonite. The particles should also be finely divided, having a maximum diameter of about 40 mesh U.S. sieve series, and preferably smaller than 100 mesh, and most preferably less than 10 microns. In one embodiment, naturally occurring catalyst are preferred. Such catalysts are effective, relatively cheap and widely available in sufficient quantities. Finely ground limonite, a naturally occurring iron oxide/hydroxide mineral is especially preferred.

The catalytic-hydrotreating reaction zone may be a fixed, ebullating, or moving bed all of which are well known to those skilled in the art.

In the catalytic-hydrotreating reaction zone, predominately hydrogenation occurs which further stabilizes unstable molecules from the thermal-catalytic zone and also removes heteroatoms such that the product will also have been substantially desulfurized, denitrified, and deoxygenated. Some cracking also occurs simultaneously, such that some higher-molecular-weight compounds are converted to lower-molecular-weight compounds.

Catalyst used in the catalytic-hydrotreating zone may be any of the well-known, commercially available hydroprocessing catalysts. A suitable catalyst for use in this reaction zone comprises a hydrogenation component supported on a suitable refractory base. Suitable bases include silica, alumina, or a composite of two or more refractory oxides. Suitable hydrogenation components are selected from Group VI-B metals, Group VIII metals and their oxides, sulfides or mixture thereof. Particularly useful are cobalt-molydenum, nickel-molybdenum, or nickel-tungsten.

In the catalytic-hydrotreating zone, it is preferred to maintain the temperature below 800° F., preferably in the range of 600° F. to 800° F., and more preferably between 650° F. to 780° F. to prevent catalyst fouling. Other hydrocatalytic conditions include a hydrogen partial pressure from 35 atmospheres to 300 atmospheres, preferably 100 to 200 atmospheres, and more preferably 100 to 175 atmospheres; a hydrogen flow rate of 300 to 1500 liters per liter of feed mixture, preferably 350 to 1000 liters per liter of feed mixture; and a residence time in the range of 0.3 to 4 hours, preferably 0.5 to 3 hours.

Typical heavy hydrocarbonaceous feedstocks of the kind that find application in the process of this invention often contain undesirable amounts of metallic contaminants. Unless removed, these contaminants can result in deactivation of the second-stage hydrotreating catalyst, and/or plugging of the catalyst bed resulting in an increase in the pressure drop in the bed of supported hydrotreating catalyst. The present invention is well suited for the processing of feeds that are high in metallic contaminants because most of these contaminants are removed from the feed and deposited on undissolved coal and ash. If a relatively low amount of coal is used or if the coal is insufficient in un-dissolved coal and/or ash, additional coal ash may be added to aid in metals removal. The present invention is also particularly well suited for feeds that are derived from crudes that are high in residuum content, especially those that are also high in contaminants, since high quality products can be obtained from these lower cost crudes.

The process of the present invention produces liquid products, a significant portion of which boils below 1000° F. and which are suitable for processing to transportation fuels. The normally liquid products, that is, all of the product fractions boiling above $C_4$, have a specific gravity in the range of naturally occurring petroleum stocks. Additionally, relative to the feed, the total product will have at least 80 percent of sulfur removed and at least 30 percent of nitrogen removed. Products boiling in the transportation fuel range may require additional upgrading prior to use as a transportation fuel.

The process is operated at conditions and with sufficient severity to convert at least fifty (50) percent of the heavy oil feedstock boiling above 1000° F. to products boiling below 1000° F., and preferably at least seventy-five (75) percent conversion and more preferably to at least ninety (90) percent conversion.

In this specification and drawing, the invention has been described with reference to specific embodiments. It will, however, be evident that various modifications and changes can be made thereto without departing from the broader spirit and scope of the invention as set forth in the appended claims. The specification is, accordingly, to be regarded in an illustrative rather than a restrictive sense. Therefore, the scope of the invention should be limited only by the appended claims.

The invention claimed is:

1. A process for conversion of heavy oils to produce lower boiling hydrocarbon products comprising:

a) dispersing finely divided coal and catalyst in a heavy oil feedstock to obtain a dispersed mixture,
   wherein the amount of coal relative to the feedstock is from about 3 to 10 percent by weight and the amount of dispersed catalyst relative to the feedstock is from about 0.1 to 5 percent by weight, b) heating and passing the dispersed mixture together with hydrogen to a first reaction zone comprising one or more thermo-catalytic reactors, c) converting a portion of the coal into coal liquids in the first reaction zone, d) mixing heavy oils in the heavy oil feedstock, the coal liquids, and the dispersed catalyst in the first reaction zone to convert the heavy oils to an effluent comprising hydrocarbons boiling below 1000.degree. F., e) passing at least a portion of the effluent comprising hydrocarbons boiling below 1000.degree. F. reduced in temperature to a second reaction zone comprising one or more catalytic-hydrotreating reactors and having a supported hydrotreating catalyst, and f) recovering a product of the second reaction zone,
   wherein the first and second reaction zones are close-coupled and operated at elevated temperature and pressure.

2. The process of claim 1 wherein substantially all effluent from the first reaction zone is passed into the second reaction zone.

3. The process of claim 1 wherein some gaseous product is removed from the effluent of the first reaction zone before passing the effluent to the second reaction zone.

4. The process of claim 1 wherein the dispersed catalyst is oxides or sulfides of metals selected from the group consisting of Group V1b, V11b and V111b metals.

5. The process of claim 1 wherein the dispersed catalyst is either a synthetic catalyst or a naturally occurring material.

6. The process of claim 5 wherein the dispersed catalyst is limonite, a naturally occurring iron oxide/hydroxide mineral.

7. The process of claim 1 wherein the temperature of said first reaction zone is maintained within a range of between 750.degree. F. and 900.degree. F.

8. The process of claim 1 wherein the temperature of said first reaction zone is maintained within a range of between 800.degree. F. and 875.degree. F.

9. The process of claim 1 wherein the product from the second reaction zone is separated into gaseous, liquid and liquid/solid bottom fractions and wherein a portion of the liquid fraction, the liquid/solid bottom fraction, or both is recycled back to a feed system.

10. The process of claim 1 wherein the product from the second reaction zone is separated into gaseous and liquid/solid bottom fractions and wherein a portion of a gaseous fraction containing hydrogen is recycled to the second reaction zone.

11. The process of claim 1 wherein the product from the second reaction zone is separated into gaseous and liquid/solid bottom fractions and wherein a portion of a gaseous fraction containing hydrogen is recycled to the first reaction zone.

12. The process as claimed in claim 1 wherein the temperature of the second reaction zone is between 600.degree. F. and 800.degree. F.

13. The process as claimed in claim 1 wherein the percentage of heavy oils in the feedstock converted to hydrocarbons boiling below 1000.degree. F. is at least 50 percent.

14. The process as claimed in claim 1 wherein the percentage of heavy oils in the feedstock converted to hydrocarbons boiling below 1000.degree. F. is at least 75 percent.

15. The process of claim 1 wherein said heavy oil feedstock is selected from the group consisting of crude petroleum, topped crude petroleum, reduced crudes, petroleum residua from atmospheric or vacuum distillations, solvent deasphalted tars and oils, and heavy hydrocarbonaceous liquids derived from coal, bitumen, or coal tar pitches.

16. The process of claim 1 wherein said heavy oil feedstock is co-processed with oil selected from the group consisting of VGO, Coker Gas Oil, FCC Cycle Oil, and mixtures thereof.

17. The process of claim 1 wherein the amount of catalyst relative to the feedstock is from about 0.5 to 1 percent by weight.

18. The process of claim 1 wherein the residence time of the dispersed mixture in the first reaction zone is from about 0.5 to 3 hours.

19. The process of claim 1 wherein the residence time of effluent in the second reaction zone is from about 0.3 to 4 hours.

20. The process as claimed in claim 1 wherein the supported hydrotreating catalyst in said second reaction zone is maintained in a fixed, ebullated or moving bed within the reaction zone.

21. The process as claimed in claim 1 wherein the process is maintained at a hydrogen partial pressure from about 35 atmospheres to 300 atmospheres.

22. The process as claimed in claim 1, further comprising converting a portion of the coal into coal ash in the first reaction zone.

23. The process as claimed in claim 22 further comprising substantially removing metal contaminants in the feedstock in the first reaction zone by sequestering the metal contaminants with the coal ash.

* * * * *